United States Patent [19]

Moore et al.

[11] Patent Number: 4,865,131

[45] Date of Patent: Sep. 12, 1989

[54] METHOD AND APPARATUS FOR STIMULATING HYDRAULICALLY PUMPED WELLS

[75] Inventors: Brian K. Moore, Lafayette, La.; Donald R. Morris, Heidelberg, Miss.

[73] Assignee: Camco, Incorporated, Houston, Tex.

[21] Appl. No.: 297,274

[22] Filed: Jan. 17, 1989

[51] Int. Cl.[4] ..... E21B 21/00; E21B 19/22; E21B 33/127; E21B 43/25

[52] U.S. Cl. ..... 166/384; 166/77; 166/307; 166/386; 166/387

[58] Field of Search ..... 166/77, 384, 386, 387, 166/373, 311, 312, 305.1, 307, 187, 372

[56] References Cited

U.S. PATENT DOCUMENTS 3,373,816 3/1968 Cochran ..... 166/384 X
4,440,227 4/1984 Holmes ..... 166/261
4,627,496 12/1986 Ashford et al. ..... 166/291 X
4,662,448 5/1987 Ashford et al. ..... 166/292 X
4,671,359 6/1987 Renfro ..... 166/312
4,793,417 12/1988 Rumbaugh ..... 166/312

*Primary Examiner*—Stephen J. Novosad
*Attorney, Agent, or Firm*—Fulbright & Jaworski

[57] ABSTRACT

A method and apparatus of stimulating a well having a hydraulic pump seated in an internal shoulder in the production tubing for pumping fluid through a fluid port to the annulus between the tubing and casing. The method includes removing the pump but leaving the production tubing in place. A coil tubing having a fluid injector is lowered into the production tubing and sealingly seated on to the shoulder. The injector is maintained on the seat and the packer is maintained in place by pressuring fluid on to the top of the seated injector and the packer. An inflatable packer may be provided on the coil tubing for anchoring the coil tubing in place.

15 Claims, 1 Drawing Sheet

METHOD AND APPARATUS FOR STIMULATING HYDRAULICALLY PUMPED WELLS

BACKGROUND OF THE INVENTION

It is conventional in oil wells to hydraulically pump oil from the ground by the use of a downhole pump positioned in a pump bottom hole assembly in the production tubing. In one embodiment, power fluid is pumped down the production tubing to actuate the downhole pump, and the well fluids and exhausted power fluid is produced through a fluid port in the bottom hole assembly and up the annulus between the production tubing and casing.

However, at various times it is necessary to stimulate the production formation in the well, for example, acidizing the well. At the present time, in order to accomplish this, it is necessary to withdraw both the hydraulic downhole pump along with the production tubing bottom hole assembly and production packer prior to fluid injection into the well producing formations. The operation of withdrawing the production tubing and its attachments requires moving a workover rig into position at the well and is both time-consuming and expensive.

The present invention is directed to an apparatus and method of stimulating such wells which avoid pulling the production tubing and the attached production packer and hydraulic bottom hole assembly, and therefore does not require the use of a workover rig. Instead, the present apparatus and method utilizes a coil tubing having an injector at its lower end with a sealing device. By pulling the hydraulic pump, but leaving the production tubing and bottom hole assembly in place, the coil tubing and sealing device of the present invention may sealingly seat in the bottom hole assembly which is left in place. This allows the well formation to be quickly and inexpensively stimulated.

SUMMARY

The present invention is directed to a method and apparatus of stimulating a well having a production tubing extending in a well casing with a production packer therebetween. The tubing includes an internal shoulder and a fluid port above the packer communicating between the inside of the tubing and the casing. A hydraulic pump is seated on the shoulder for pumping fluid from the well. The present method includes removing the hydraulic pump from the production tubing while leaving the production tubing in place, and lowering a coil tubing having a fluid injector at its lower end into the production tubing. The method includes sealingly seating the injector onto the shoulder and pressuring fluid against the top of the seated injector and against the top of the production packer for maintaining the injector on the seat and maintaining the packer in place while stimulating the well through the coil tubing.

A still further object of the present invention is wherein the fluid is inserted into the annulus between the production tubing and the casing and through the fluid port.

Still a further object of the present invention is wherein fluid is inserted into the annulus between the coil tubing and the production tubing and through the fluid port. Yet a further object of the present invention is, after stimulating the well, of injecting gas down the coil tubing and up the annulus between the coil tubing and the production tubing for returning liquids in the well to the well surface.

Still a further object of equalizing the fluid pressure between the inside of the coil tubing, the annulus between the casing and the production tubing, and the annulus between the production tubing and the coil tubing.

Yet a still further object of the present invention is wherein an inflatable packer is positioned connected to the coil tubing above the fluid injector. The method includes inflating the inflatable packer to seal off between the coil tubing and the inside of the production tubing at a point above the fluid port for providing an anchor for holding the injector sealingly seated.

The method also includes stimulating the well by injecting a stimulation fluid through the coil tubing and out of the fluid injector. After stimulating the well, stimulating fluids are removed from the well, fluid is injected downwardly for equalizing the well and both annulus, the coil tubing is removed from the production tubing, and if an inflatable packer is used, it is deflated prior to removal.

A further object of the present invention is the provision of an apparatus for stimulating wells in which a production tubing extends in a casing and includes an internal shoulder and a fluid port above the shoulder communicating between the inside of the tubing and the casing. The apparatus includes a coil tubing with a fluid injector at its lower end in which the injector includes means for seating on the internal shoulder of the production tubing and includes means for sealingly engaging the internal shoulder. A fluid inflatable packer may be connected to the coil tubing at a position above the injector for positioning above the fluid port when the injector is seated on the shoulder. The coil tubing may include valve means for opening and closing communication between the inside of the coil tubing and the annulus between the coil tubing and the production tubing, and equalizing means.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
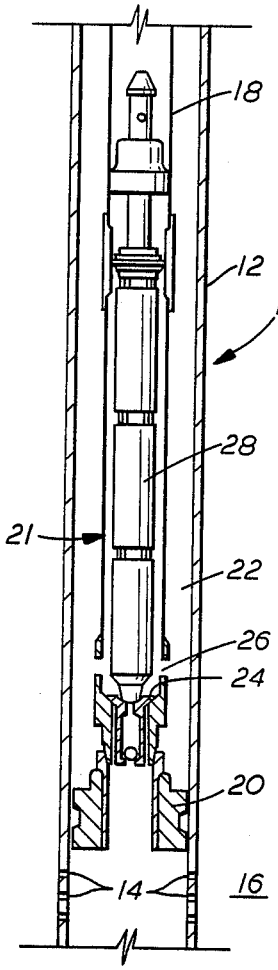
FIG. 1 (PRIOR ART)
FIG. 1 is a schematic elevational view of a prior art hydraulic pumping system installed in a well.

Referring now to FIG. 1, a conventional hydraulic pumping system is shown in an oil well for pumping production fluid therefrom. The installation is generally indicated by the reference numeral 10 and includes a casing 12 having perforations 14 for producing oil from formation 16. Production tubing 18 extends downwardly through the casing 12 and is connected to a packer 20 which seals the lower end of the annulus 22 between the outside of the production tubing 18 and the inside of the casing 12. The lower end of the production tubing 18 includes a pump bottom hole assembly 21 which includes an internal shoulder or seat 24 and one or more fluid ports 26 communicating between the inside of the production tubing 18 and the casing 12. A conventional hydraulic pumping unit 28 is shown positioned in the production tubing 22 seated on the seat 24. Power fluid is then pumped down the production tubing 18 to actuate the pumping unit 28 and the power fluid and produced oil is Produced through the fluid ports 26 and up the casing annulus 22.

However, it is necessary to stimulate the production formation 16, for example, by acid which requires injecting the stimulation treatments through the perforations 14 and into the formation 16. In the past this has required that both the hydraulic pumping unit 28 and the production tubing 18 be removed from the casing 12 prior to injecting stimulation fluids into the well. The operation of withdrawing the production tubing 18 along with the connected well packer 20 and bottom hole assembly 21 requires that a workover rig be moved onto the well site, which is both time-consuming and expensive.

The present invention is directed to a method of stimulating wells in which the hydraulic pump 28 may be removed but the production tubing 18 and its connected bottom hole assembly 21 and packer 20 may remain in place thereby avoiding the use and expense of a workover rig. However, in leaving the production tubing 18 along with the bottom hole assembly 21 which includes the shoulder 24 and fluid ports 26, the stimulation fluid may escape through the fluid ports 26. The pressure of the injected fluid and/or the type of stimulation may cause damage in the annulus 22 and pressure in the well may damage the Packer 20. The present invention allows the production tubing 18 to remain in place and stimulates the well by means of a coil tubing inserted inside of the production tubing 18 with a suitable sealing means attached thereto which will enable the formation 16 to be stimulated with the production tubing 18 and hydraulic pump bottom hole assembly 21 left in place.

Figure 2:
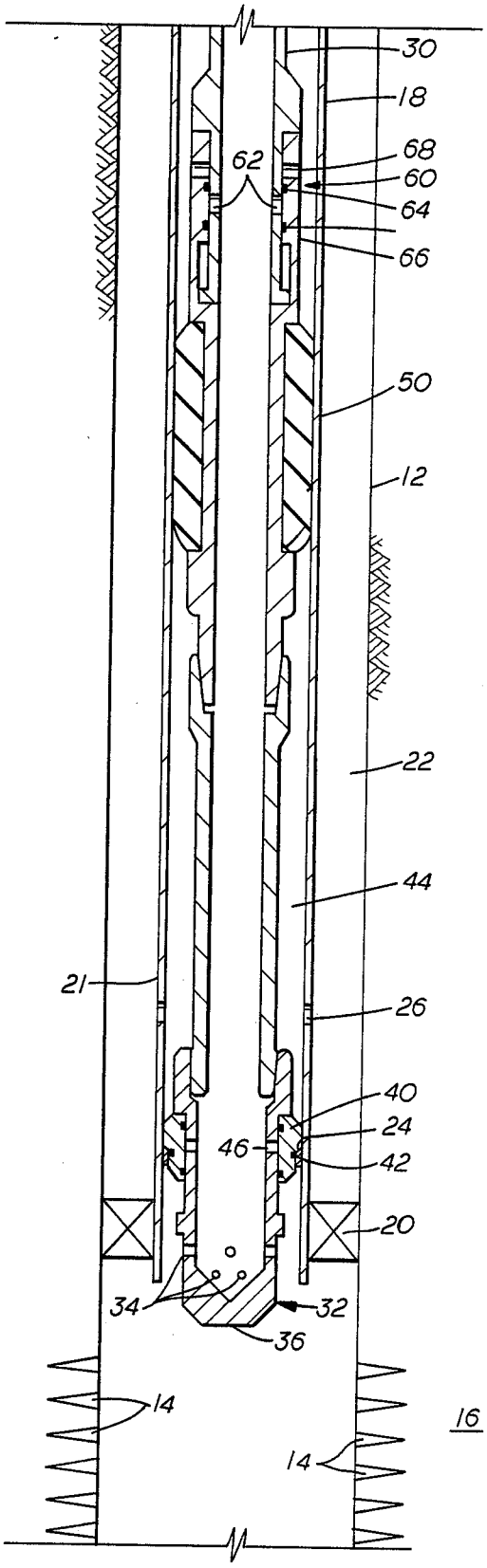
FIG. 2 is an enlarged schematic elevational view of the present invention in place in the production tubing of the well of FIG. 1.

Referring now to FIG. 2, the method and apparatus of the present invention is generally shown in which the hydraulic pump 28 has been removed, which can be done without a workover rig, but the production tubing 18 and its bottom hole assembly 21 is left in place.

A coil tubing 30 is lowered into the production tubing 18. Coil tubing is a continuous conduit without joints carried on a reel which can be lowered into production tubing and generally is of a small diameter such as 1 to 1½ inches. The coil tubing 30 has a fluid injector 32 at its bottom end which may include a plurality of nozzles 34 or merely be open-ended. If desired, a ball catcher 36 may be provided at its lower end for reasons which will be more fully discussed hereinafter.

A no-go assembly 40 is provided connected to the injector 32 and is adapted to coact with and seat on the ring seat 24. In addition, the no-go 40 includes seal means 42 for sealing off the annulus 44 between the outside of the coil tubing 30 and the inside of the production tubing 18 by sealing against the inside of the production tubing 18 such as against the ring seat 24.

Figure 3:
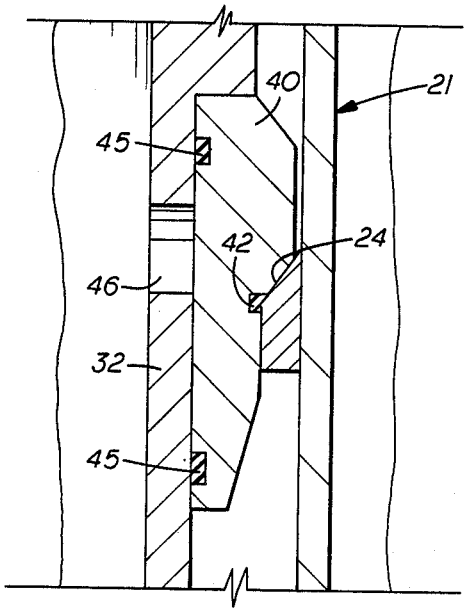
FIG. 3 is an enlarged fragmentary elevational view of the no-go seal assembly of the present invention.

Preferably, the no-go assembly may act as an equalizing valve. That is, as best seen in FIGS. 2 and 3, the no-go assembly 40 is slidably and telescopically movable on the exterior of the injector 34. In the position shown in FIGS. 2 and 3, O-ring seals 45 are in the position to block passageway 46. When it is desired to remove the coil tubing 30 from the production tubing 18, the tubing 30, the annulus 22 and the annulus 44 between the tubing 30 and tubing 18 will be filled with fluid. Therefore, in order to equalize the various fluids, the coil tubing must be picked up sufficiently to move the passageways 46 above the no-go assembly 40 to allow fluid equalization.

After the no-go assembly 40 is seated and sealed against the seat 24, as best seen in FIG. 2, suitable means must be provided to hold and maintain the no-go assembly 40 and seal 42 in position prior to injecting stimulation fluid down the coil tubing 30. Otherwise, the pressurized stimulation fluid will raise the no-go assembly 40 off of the seat 24 and allow the stimulation fluid and its pressure to pass through the fluid ports 26 into annulus 22.

One way of maintaining the no-go assembly 40 sealingly seated on the seat 24 is to insert liquid onto the top of the no-go assembly in the annulus 44. Since the no-go assembly acts as a piston the hydrostatic force of the liquid in the annulus 44 or, if desired, pressure may be applied from the well surface against the liquid to maintain a hydraulic force on the no-go assembly for maintaining its sealing relationship with the seat 24.

The liquid can be injected and/or pressurized, by injecting into the casing annulus 22 or in the annulus 44 between the inside of the production tubing 18 and the exterior of the coil tubing 30. It is important that pressurized fluid be provided in the annulus 22 acting on the top of the production packer 20 to maintain it in position when the well is stimulated by high pressure fluids which act on the bottom of the packer 20.

As an alternative, or in addition to the use of liquid pressure on the no-go assembly 40, an inflatable packer 50 may be connected to the coil tubing 30 at a Position above the fluid ports 26. A conventional inflatable packer model such as TAM single set sold by TAM International may be used. In such a packer the packer is initially inflated by dropping a first ball therethrough which actuates the packer for fluid inflation. The optional ball catcher 36 may be used to catch the ball if desired. After the packer 50 is set, it forms both a Pack-off between the coil tubing 30 and the interior of the production tubing 18 as well as an anchor. The inflatable packer may be used by itself as an anchor to hold the lower end of the coil tubing 30 and thus the no-go seal assembly 40 in a sealingly seated relationship with the valve seat 24. However, the packer 50 may also be used in combination with liquid for applying a hydraulic force on the no-go assembly 40 for maintaining the no-go 40 in a seated relationship. For example, liquid may be inserted into the annulus 44, through the fluid ports 26, and pressurized against the top of the inflated packer 50 to maintain a hydraulic force on the no-go assembly 40. Pressurized fluid in the casing annulus 22 will flow through parts 26 and exert an upward force on the bottom of packer 50 which has a larger piston area than the piston area of the assembly 40. In order to overcome this upward force, the downwardly acting pressurized fluid in the annulus 44 above the packer 50 may be required to maintain the seal of assembly 40 against the seat 24.

In any event, after the no-go assembly is maintained in a seated position against the seat 24, stimulation fluid may be pumped down the interior of the coil tubing 30 and out of the injector 32 for providing a stimulation treatment to the perforations 14 and the production formation 16.

Referring again to FIG. 2, valve means 60, such as a sliding sleeve valve, may be connected to the coil tubing 30 for opening and closing communication between the inside of the coil tubing 30 and the annulus 44. The valve includes an opening 62 which is closed by seals 64 on sliding sleeve 66 when the sleeve is in the position shown. A straight pick up of coil tubing 30 will place opening 62 in line with port 68 in the sleeve 66 and open the valve 60. After the completion of the stimulation treatment, the coil tubing 30 is picked up opening valve 60 while leaving the packer 50 set and the assembly 40 seated. A gas such as nitrogen may be injected down coil tubing 30, out the open valve 60 and to the surface through the tubing annulus 44 for the purpose of returning spent stimulation fluids such as acids and other well formation fluids to the well surface.

Thereafter liquids may be injected down the inside of coil tubing 30 and the annulus 44 for the purpose of equalizing the pressure in the annulus 44 and annulus 22. In the case where the inflatable packer is used, a second ball is dropped which deflates the above-described inflatable packer 50. Another upward pull of the coil tubing 30 will open passageway 46 of the assembly 40. This will allow pressure equalization between the well formation and both annulus 22 and 44. Thereafter the coil tubing 30 is removed from the production tubing 18. After removal of the coil tubing, the hydraulic pumping unit 28 may be reinstalled into the production tubing 18 and the bottom hole assembly 21.

Therefore, the apparatus and method of the present invention provides a new method of stimulating wells in which hydraulic pumping units have been installed without requiring the removal of the production tubing, production packer and hydraulic pump bottom hole assembly The present invention, therefore, is well adapted to carry out the objects and attain the ends and advantages mentioned as well as others inherent therein. While a presently preferred embodiment of the invention has been given for the purpose of disclosure, numerous changes in the details of construction, arrangement of parts, and steps of the method, will be readily apparent to those skilled in the art, and which are encompassed within the spirit of the invention and the scope of the appended claims.

What is claimed is:

1. A method of stimulating a well having a production tubing extending in a well casing with a production packer therebetween in which the production tubing includes an internal shoulder and a fluid port above the shoulder communicating between the inside of the tubing and the casing, with a hydraulic pump seated on the shoulder for pumping fluid from the well, comprising, removing the hydraulic pump from the production tubing while leaving the production tubing in place, lowering a coil tubing having a fluid injector at its lower end into the production tubing, sealingly seating the injector onto the shoulder, pressuring fluid against the top of the seated injector and against the top of the production packer for maintaining the injector on the seat and maintaining the packer in place and stimulating the well through the coil tubing through the injector.

2. The method of claim 1 wherein the pressurized fluid is inserted into the annulus between the production tubing and the casing and through the fluid port.

3. The method of claim 1 wherein pressurized fluid is inserted into the annulus between the coil tubing and the production tubing and through the fluid port.

4. The method of claim 1 including, after stimulating the well through the coil tubing, of injecting gas down the coil tubing and up the annulus between the coil tubing and the production tubing for returning liquids in the well to the well surface.

5. The method of claim 1 including, after stimulating the well through the coil tubing, of equalizing the fluid pressure between the inside of the coil tubing, the annulus between the casing and the production tubing, and the annulus between the production tubing and the coil tubing.

6. A method of stimulating a well having a production tubing extending in a well casing with a production packer therebetween in which the production tubing includes an internal shoulder and a fluid port above the shoulder communicating between the inside of the tubing and the casing, with a hydraulic pump seated on the shoulder for pumping fluid from the well comprising, removing the hydraulic pump from the production tubing while leaving the production tubing in place, lowering a coil tubing having a fluid injector at its lower end and an inflatable packer positioned above the fluid injector into the production tubing, sealingly seating the injector onto the shoulder, inflating the inflatable packer to seal off between the coiled tubing and the inside of the production tubing at a point above the fluid port, stimulating the well by injecting stimulation fluid through the coil tubing and out of the fluid injector, deflating the inflatable packer, and removing the coiled tubing from the production tubing.

7. The method of claim 6 including, pressuring fluid into the annulus between the production tubing and the casing and against the top of the production packer for maintaining the production packer in place while injecting stimulation fluid.

8. The method of claim 6 including, pressuring fluid against the top of the seated injector and against the top of the set inflatable packer for maintaining the injector on the seat.

9. The method of claim 7 including, pressuring fluid against the top of the seated injector and against the top of the set inflatable packer for maintaining the injector on the seat.

10. The method of claim 9 including, after stimulating the well through the coil tubing, of injecting gas down the coil tubing and up the annulus between the coil tubing and the production tubing for returning liquids in the well to the well surface.

11. The method of claim 9 including, after stimulating the well through the coil tubing, of equalizing the fluid pressure between the inside of the coil tubing, the annulus between the casing and the production tubing, and the annulus between the production tubing and the coil tubing.

12. An apparatus for stimulating wells in which a production tubing extends in a well casing with a production packer therebetween in which the production tubing includes an internal shoulder and a fluid port above the shoulder communicating between the inside of the tubing and the casing comprising, coil tubing with a fluid injector at its lower end, said injector including means for seating on the internal shoulder and means for sealingly engaging the internal shoulder, and a fluid inflatable packer connected to the coil tubing at a position above the injector for positioning above the fluid port when the injector is seated on the shoulder.

13. The apparatus of claim 12 including, equalizing means connected to the coil tubing for equalizing the fluid pressure between the inside of the coil tubing, the annulus between the casing and the production tubing, and the annulus between the production tubing and the coil tubing.

14. The apparatus of claim 13 including, valve means connected to the coil tubing for opening and closing communication between the inside of the coil tubing and the annulus between the coil tubing and the production tubing.

15. An apparatus for stimulating wells in which a production tubing extends in a well casing with a production packer therebetween, in which the production tubing includes an internal shoulder and a fluid port above the shoulder communicating between the inside of the tubing and the casing comprising, coil tubing with a fluid injector at its lower end, said injector including means for seating on the internal shoulder and sealingly engaging the internal shoulder, and valve means connected to the coil tubing for opening and closing communication between the inside of the coil tubing and the annulus between the coil tubing and the production tubing.

* * * * *